US006508144B1

(12) United States Patent
Vendetti et al.

(10) Patent No.: US 6,508,144 B1
(45) Date of Patent: Jan. 21, 2003

(54) QUICK ZEROING KNOB ASSEMBLY

(75) Inventors: Vincent J. Vendetti, Fredericksburg, VA (US); Michael M. Canaday, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/861,982

(22) Filed: May 14, 2002

Related U.S. Application Data

(63) Continuation-in-part of application No. 09/372,107, filed on Aug. 11, 1999, now abandoned.

(51) Int. Cl.[7] ..... G05G 1/10; G05G 5/06; F41G 1/38; F41G 1/42

(52) U.S. Cl. ..... 74/553; 74/527; 42/126; 33/298

(58) Field of Search ..... 74/527, 553, 528; 42/124, 126, 112, 125, 127, 136, 137; 33/298

(56) References Cited

U.S. PATENT DOCUMENTS

| | | | | | |
|---|---|---|---|---|---|
| 2,585,933 | A | | 2/1952 | Harvey | 33/55 |
| 3,662,618 | A | * | 5/1972 | Kroll et al. | 74/527 |
| 4,038,757 | A | | 8/1977 | Hicks et al. | 33/247 |
| 4,457,076 | A | * | 7/1984 | Heck | 33/265 |
| 4,554,745 | A | | 11/1985 | Repa | 33/257 |
| 4,686,770 | A | * | 8/1987 | Aigner | 33/257 |
| 4,815,217 | A | * | 3/1989 | Repa | 33/257 |
| 5,245,886 | A | * | 9/1993 | Truesdell et al. | 74/501.6 |
| 5,345,050 | A | * | 9/1994 | Branch | 200/341 |
| 5,493,450 | A | * | 2/1996 | Ekstrand | 359/799 |
| 5,513,440 | A | * | 5/1996 | Murg | 33/246 |
| 5,659,965 | A | | 8/1997 | Thibodeau et al. | 33/261 |
| 5,694,815 | A | * | 12/1997 | Biber et al. | 74/528 |
| 5,862,715 | A | * | 1/1999 | Lemire | 74/553 |
| 6,345,464 | B1 | * | 2/2002 | Kim et al. | 42/114 |
| 6,418,657 | B1 | * | 7/2002 | Brown | 42/124 |

FOREIGN PATENT DOCUMENTS

| | | | | |
|---|---|---|---|---|
| EP | 0366445 | * | 5/1990 | 74/553 |
| JP | 11-24775 | * | 1/1999 | 74/553 |

* cited by examiner

*Primary Examiner*—Vinh T. Luong
(74) *Attorney, Agent, or Firm*—James B. Bechtel, Esq.; Peter J. Van Bergen, Esq.; Matthew J. Bussan, Esq.

(57) ABSTRACT

A control knob assembly is disclosed that may be generally used for the quick zeroing adjustment of a dial thereof. A control knob assembly includes a housing with a shaft rotatably supported therein. A ring is coupled to the shaft in such a way that rotation of the ring causes rotation of the shaft. The ring has a plurality of holes distributed there-around and extending longitudinally therethrough from a first side thereof to a second side thereof. A knob is disposed about the shaft adjacent the first side of the ring. The knob is rotatable about the shaft and slidable therealong. A spring is coupled between the knob and ring for biasing the knob towards the ring. A pin extends from the knob to engage one of the holes at the first side of the ring when the spring is free to bias the knob towards the ring. A spring-loaded detent mechanism mounted in the housing engages one of the holes from the second side of the ring. The detent mechanism permits rotation of the ring relative to the housing when the spring is free to bias the knob towards the ring. However, the detent mechanism inhibits rotation of the ring relative to the housing when the spring's bias is overcome by a pulling force that causes the pin to disengage from one of the holes at the first side of the ring.

10 Claims, 5 Drawing Sheets

10
12
4
4
14
3
3
26A
36
22
22A
38
40
26B
50
28

FIG. 3
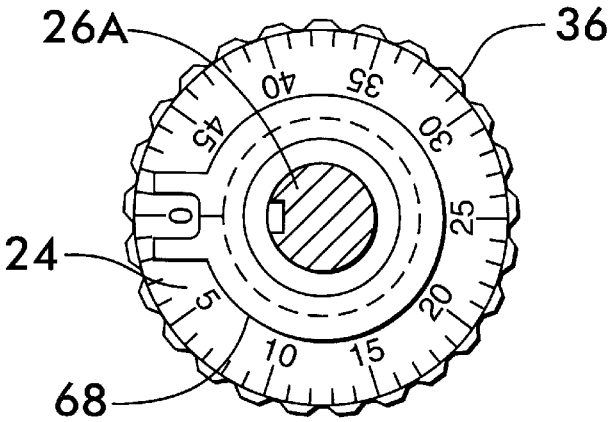
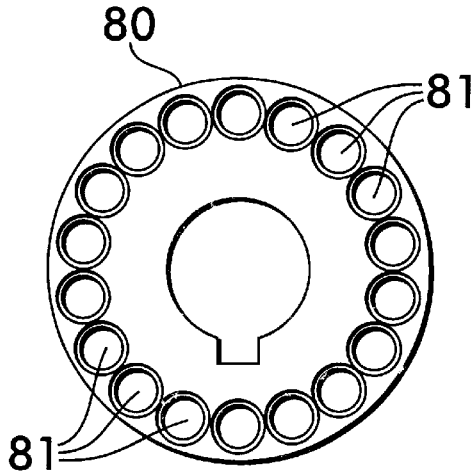
FIG. 6A
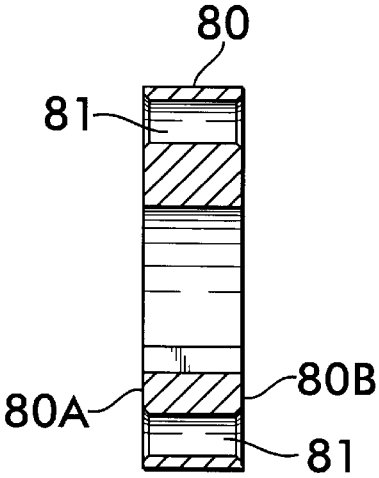
FIG. 6B

QUICK ZEROING KNOB ASSEMBLY

This is a continuation-in-part of now abandoned application Ser. No. 09/372,107 filed Aug. 11, 1999 now abandoned.

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The present invention relates generally to firearm technology, and more particularly to a control knob assembly for rapid zeroing of a position adjusting mechanism such as those found on automatic, tripod-mounted guns.

BACKGROUND OF THE INVENTION

Automatic guns mounted on tripods typically have a variety of position adjustments that must be made for proper aiming of the gun. Such position adjustments are often made using control knobs. These control knobs must often be returned to a reference or zero point once the particular adjustment is made. Thus, as used herein, zeroing involves the process of first turning a control knob some number of degrees (based on a scale that is referenced to the knob) to adjust the position of the gun and then, without changing the position of the gun, moving the scale to "zero", i.e., a base or reference point.

Prior art zeroing systems typically use an incremented ring that is separate from the knob. In these systems, the ring is either moved into place against some friction after the knob is in position, or the ring is unlocked, moved, and then locked back down. Ideally, a zeroing system for a control knob should be easier and faster to use than the prior art systems.

SUMMARY OF THE INVENTION

Accordingly, it is a primary object of the present invention to provide a control knob assembly that can be easily operated to zero an automatic gun.

It is another object of the present invention to provide a control knob assembly for zeroing an automatic gun in one motion by pulling out a knob, rotating the knob to zero, and then letting the knob snap back in place without causing the gun to move.

In accordance with these and other objects, a control knob assembly includes a housing with a shaft rotatably supported therein. A ring is coupled to the shaft in such a way that rotation of the ring causes rotation of the shaft. The ring has a plurality of holes distributed therearound and extending longitudinally therethrough from a first side thereof to a second side thereof. A knob is disposed about the shaft adjacent the first side of the ring. The knob is rotatable about the shaft and slidable therealong. A spring is coupled between the knob and ring for biasing the knob towards the ring. A pin extends from the knob to engage one of the holes at the first side of the ring when the spring is free to bias the knob towards the ring. A spring-loaded detent mechanism mounted in the housing engages one of the holes from the second side of the ring. The detent mechanism permits rotation of the ring relative to the housing when the spring is free to bias the knob towards the ring. However, the detent mechanism inhibits rotation of the ring relative to the housing when the spring's bias is overcome by a pulling force that causes the pin to disengage from one of the holes at the first side of the ring.

In a particular application of the invention, a control knob assembly is provided that may be generally used for rapid zero adjustment of a dial thereof as is particularly required for the rapid zeroing of a traverse and elevating mechanism of an automatic gun. In one embodiment, the control knob assembly provides for rapid zeroing without altering the actual position of the mechanism in which it is employed. The mechanism has a shaft with a ring formed therein having a first opening. The shaft has first and second ends. The second end of the shaft has coupling means for coupling to an automatic gun. The control knob assembly comprises a knob, a spring, a pin, and retaining means. The knob has an interior with first, second and third cutouts each having predetermined dimensions. The knob has a second opening dimensioned to be complementary to the first opening and the first cutout is dimensioned so as to accept the insertion of the ring of the shaft. The spring has first and second ends and is dimensioned for insertion into both of the first and second cutouts. The pin is inserted into both of the openings of the knob and the ring. The retaining means abuts against and holds the spring in the first and second cutouts.

BRIEF DESCRIPTION OF THE DRAWINGS

A better understanding of the present invention may be realized when considered in view of the following detailed description in conjunction with the accompanying drawings.

FIG. 3 illustrates the pointer of the elevating portion taken along line 3—3 of FIG. 2;

FIG. 6A is an isolated plan view of the knob assembly's click ring; and

FIG. 6B is an isolated cross-sectional view of the click ring.

DETAILED DESCRIPTION OF THE INVENTION

The quick zeroing knob assembly of the present invention can be used in any position adjustment mechanism in which a control knob is turned to change the mechanism's position and then must be rotated to a "zero" (i.e., reference) position without changing the mechanism's position adjustment. By way of illustrative example, the present invention will be explained with respect to its use in an automatic gun's traverse and elevating mechanism.

Figure 1:
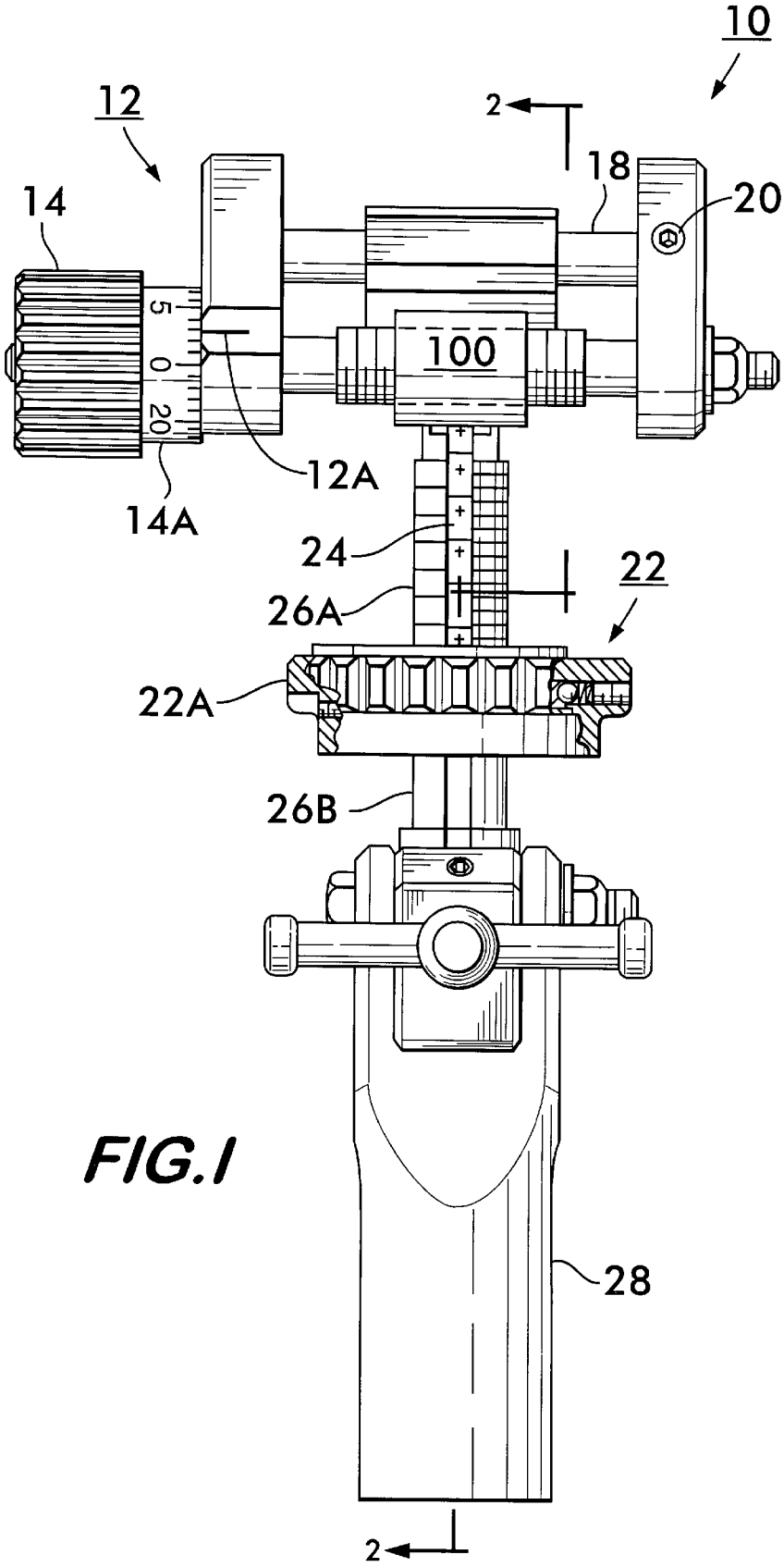
FIG. 1 illustrates a gun's traverse and elevating mechanism having a control knob assembly in accordance with an embodiment of the present invention.

Referring now to the drawings, wherein the same reference numerals are indicative of the same elements throughout, FIG. 1 illustrates an automatic gun's traverse and elevating mechanism 10 incorporating a control knob assembly 12 according to the one embodiment of the present invention. In the illustrated example, control knob assembly 12 controls the transverse portion of traverse and elevating mechanism 10, whereas elevation adjustment is provided by an elevating assembly 22. Such traverse and elevating mechanisms are used on a variety of tripod-mounted firearms as is well known in the art.

Although not part of the present invention, the illustrated elevating adjustment assembly 22 will be explained briefly herein. Assembly 22 comprises a hand wheel elevating adjustment device 22A (partially shown in section), a plate 24 scaled in elevation graduations, upper and lower elevation screws 26A and 26B, respectively, and a base 28. Base 28 is clamped to lower elevating screw 26B. Traverse and elevating mechanism 10 may be further described with reference to FIG. 2 which is a view taken along line 2—2 of FIG. 1.

Figure 2:
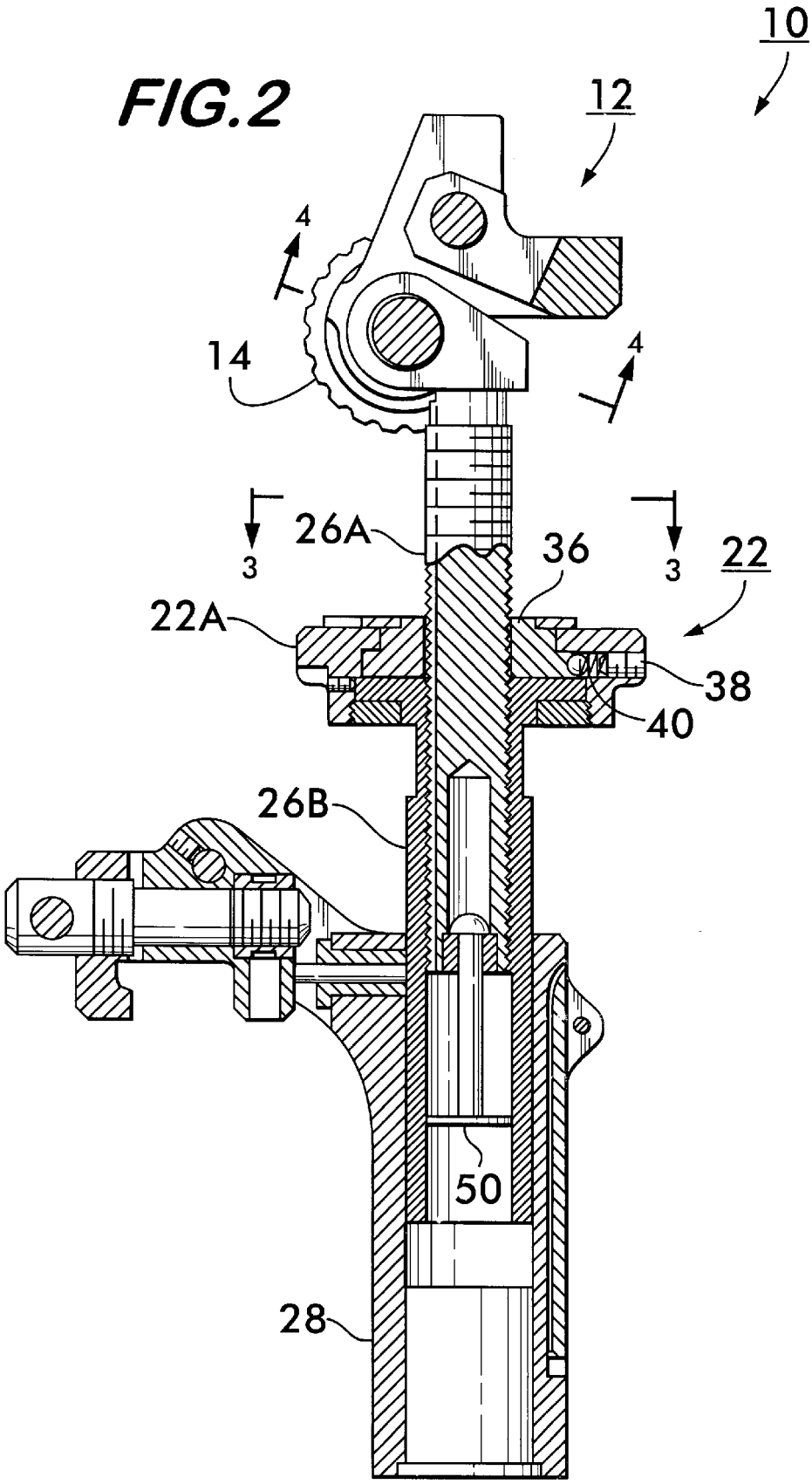
FIG. 2 is a view of the traverse and elevating mechanism taken along line 2—2 of FIG. 1.

Referring additionally now to FIG. 2, elevating adjustment assembly 22 further comprises a ring 36 for holding against the upper elevating screw 26A, and a set screw 38 cooperating with a spring 40. Lower elevating screw 26B has a stepped arrangement with its upper portion fitting between both elevating hand wheel 22A and ring 36. Upper elevating screw 26A is arranged with lower elevating screw 26B in a telescopic manner. Lower elevating screw 26B houses an upper elevating stop assembly 50.

During assembly, with a pointer 68 preferably aligned within +/−0.3 of the zero graduation mark as shown in FIG. 3, ring 36, associated with hand wheel elevating adjustment device 22A, is preferably staked at four spaced apart locations (not shown) around ring 36 so as to retain pointer 68 at its desired location.

As mentioned above, control knob assembly 12 provides position control for a portion of traverse and elevation mechanism 10. After being used in a position adjustment mode, control knob assembly 12 is set to zero by simply, in one motion, pulling a knob 14 out, turning its dial 14A until its zero graduation line is aligned with a reference mark or hairline 12A of control knob assembly 12, and then releasing knob 14 so that it snaps back to its original position. The zeroing of the present invention is accomplished without disturbing the firearm on which it is mounted.

The details of control knob assembly 12 will now be described with simultaneous reference to FIGS. 4 and 5. Control knob assembly 12 comprises a yoke or housing 70 rotatably receiving a traversing screw 78 therethrough. A washer 74 and a self-locking nut 32B retain one end of traversing screw 78 in yoke 70. Assembly 12 further includes a click ring 80 fixedly coupled to screw 78 by, for example, a woodruff key 82 that is inserted and maintained within a keyway 78A of the traversing screw 78 and a similar keyway (not shown) formed in click ring 80.

Click ring 80, illustrated in isolation in FIGS. 6A and 6B, has a plurality of through holes 81 distributed therearound. Each of holes 81 extends from one side 80A of ring 80 through to the opposing side 80B of ring 80. Each of holes 81 tapers outward to a larger diameter at each of sides 80A and 80B. Holes 81 are placed adjacent one another all around ring 80. The tapering portion of each of holes 81 can be in tangential cooperation with the tapering portions of the holes on either side thereof as illustrated in FIG. 6A. Such a construction facilitates the capture of a dowel pin on one side of click ring 80 and the capture of a ball detent on the other side of click ring 80 as will be explained further below.

Control knob assembly 12 also includes a bushing 84 having first and second ends with the second end having a lip 84A thereat. Bushing 84 is dimensioned for placement around an extending shaft portion 78B of traversing screw 78. Lip 84A abuts against a retaining means which can, for example, be provided by a self-locking nut 32C threaded onto the end of screw 78. Note that the function of bushing 84 could also be implemented simply by using a flat washer (i.e., analogous to lip 84A) without departing from the scope of the present invention. In such a case, spring 86 would simply ride about the shaft of traversing screw 78.

Figure 4:
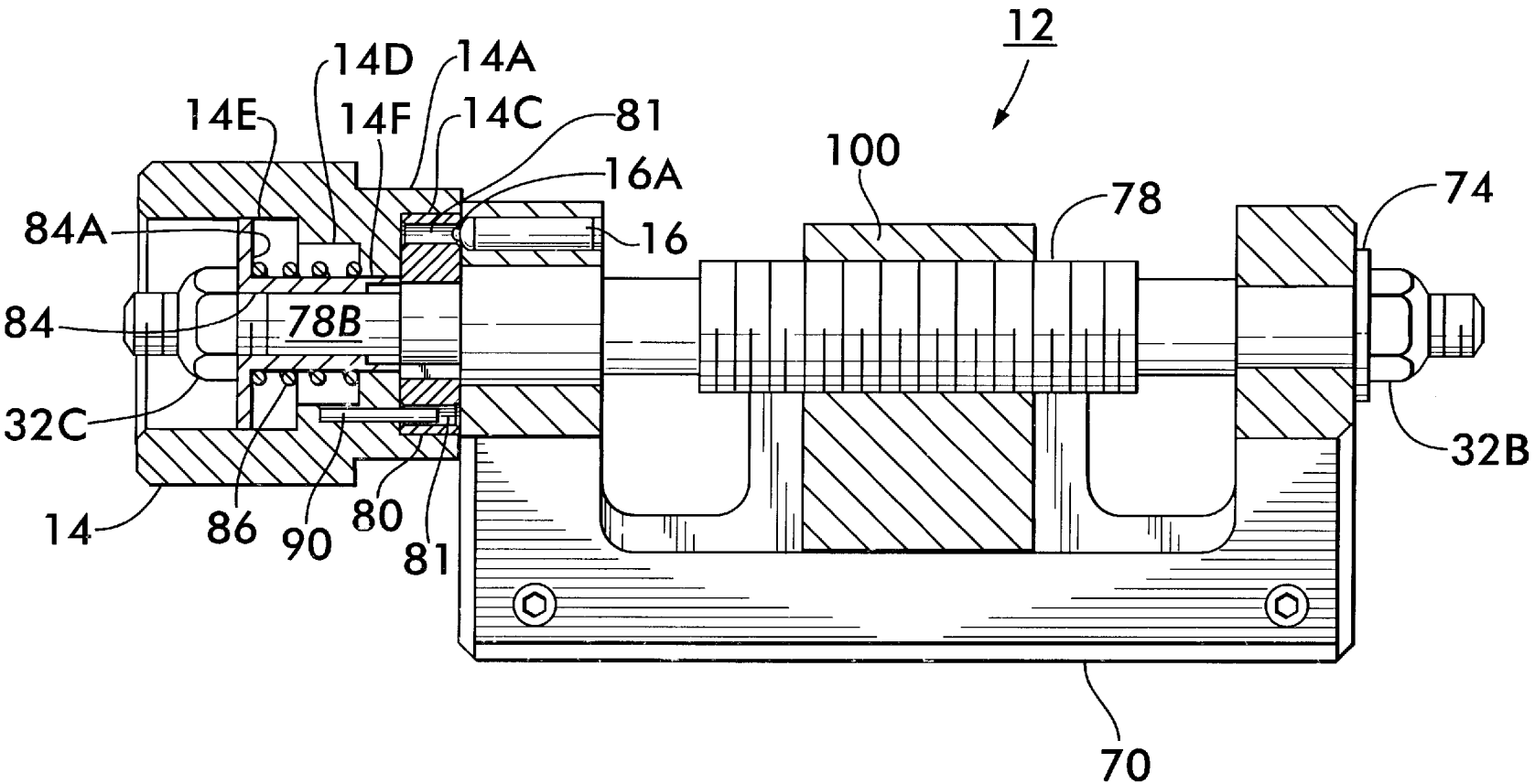
FIG. 4 illustrates one embodiment of the knob assembly of the present invention taken along the line 4—4 of FIG. 2.

Knob 14 of control knob assembly 12 has an interior with first, second and third internal cutouts, each of which has predetermined dimensions respectively defined by step regions 14C, 14D and 14E as shown in FIG. 4. Knob 14 has an exterior with first and second stepped portions, with the first exterior portion defining a dial 14A having graduations around its border and with one such graduation indicating a zero or other reference position.

As best seen in FIG. 4, the first internal cutout defined by step region 14C is dimensioned to have a diameter that accepts the insertion of click ring 80. The second internal cutout defined by step region 14D is dimensioned to have a diameter that accepts the insertion of the first end of bushing 84. The third internal cutout defined by step region 14E is dimensioned to have a diameter that is greater than the diameter of step region 14D to accept lip 84A of bushing 84. Note that a fourth step region 14F adjacent step region 14C can be provided to snugly receive bushing 84 therein and define an annular stop for a compression spring 86.

Compression spring 86 having first and second ends is dimensioned for insertion into both step regions 14D and 14E, and so that the first end of spring 86 abuts against lip 84A of bushing 84 and the second end thereof abuts against step region 14F. Control knob assembly 12 further comprises a cylindrical rod or dowel pin 90 fixed to and extending from knob 14 into step region 14C. Dowel pin 90 is dimensioned for loose insertion into one of holes 81 in click ring 80.

Click ring 80 is rigidly fastened to traversing screw 78 via a woodruff key 82. (Note that traversing screw 78 and click ring 80 could also be manufactured as a single integrated assembly thereby eliminating the need for woodruff key 82.) When knob 14 is turned, click ring 80 and traversing screw 78 turn together to move a mechanism 100 (FIGS. 1 and 5) coupled to traversing screw 78 for converting screw motion to a desired positioning movement. After mechanism 100 is properly positioned, knob 14 can be "zeroed."

It is to be understood that the present invention can be practiced other than as just described. For example, bushing 84 can be captured within knob 14 by retaining means 32C as illustrated. Bushing 84 could also be flat washer with spring 86 riding on the shaft of screw 78. Still further, bushing 84 could be manufactured as part of retaining means 32C. Thus, in general, it will be appreciated by one of ordinary skill in the art that spring 86 can be coupled between knob 14 and click ring 80 in a variety of ways without departing from the scope of the present invention.

Figure 5:
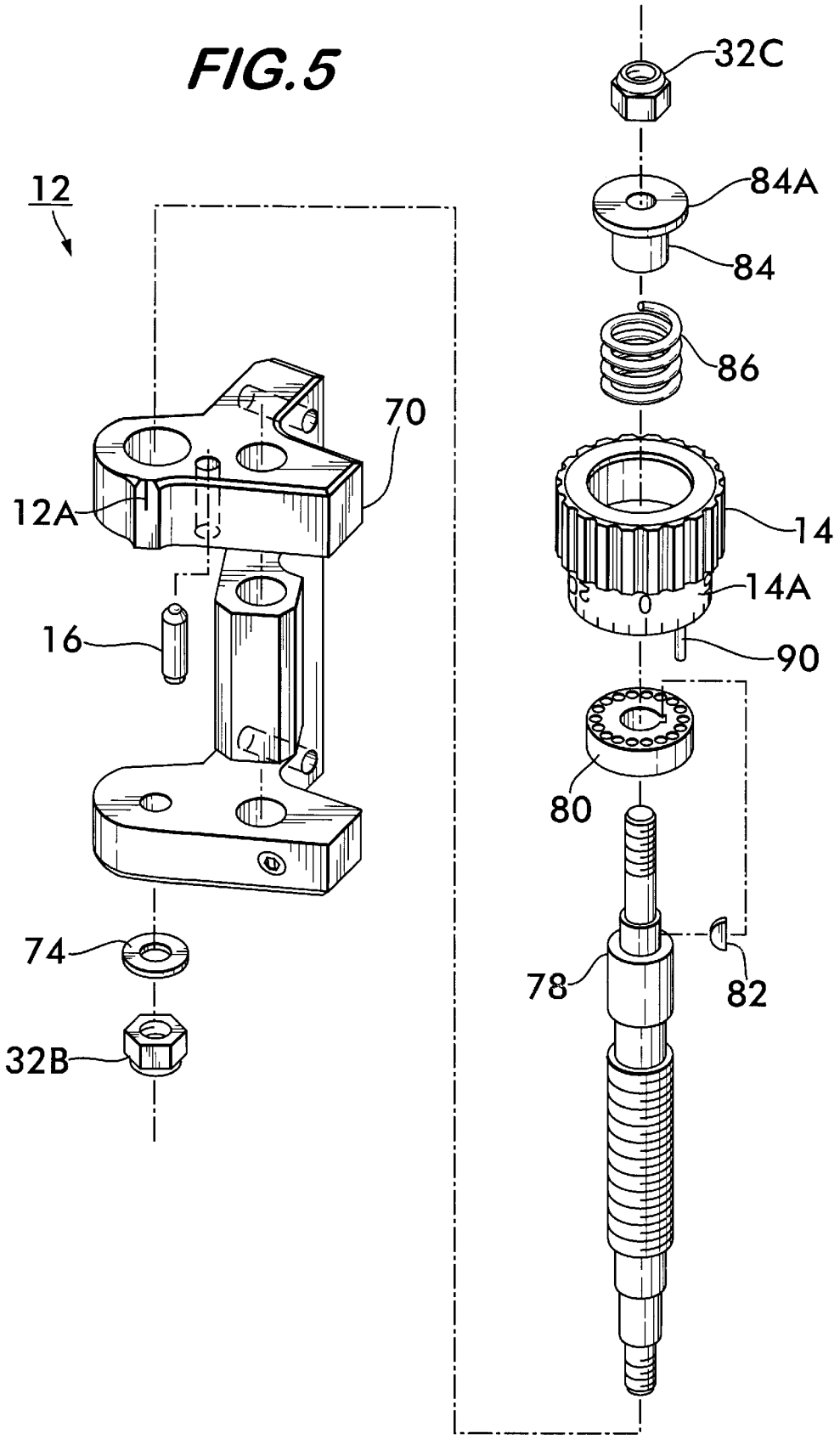
FIG. 5 is an exploded perspective view of the knob assembly of FIG. 4.

With continued reference to FIGS. 4 and 5, to zero control knob assembly 12 is zeroed by first pulling knob 14 out and away from yoke 70 along the longitudinal axis of traversing screw 78. This action compresses spring 86 and thereby releases the connection between knob 14 and click ring 80 as dowel pin 90 is pulled out of one of holes 81 of click ring 80. Knob 14 can then spin freely about screw 78 to permit the zeroing thereof. When the appropriate reference point (i.e., zero) printed on knob 14 lines up with reference mark 12A on yoke 70, knob 14 is released. As a result, spring 86 can expand to force knob 14 (and thus dowel pin 90) back into a hole 81 in click ring 80. The above-described outward taper of each of holes 81 facilitates the reception of dowel pin 90 when knob 14 is released. With dowel pin 90 in one of holes 81, knob 14 and traversing screw 78 are again locked together in their position adjusting mode.

When knob 14 is pulled out and away from yoke 70 such that dowel pin 90 disengages from one of holes 81, click ring 80 is no longer coupled thereto. During this condition, movement of click ring 80 (and screw 78 which is coupled thereto) must be prevented in order to assure no unwanted movement of mechanism 100 coupled to screw 78. The unwanted movement of click ring 80 can be prevented by a spring-loaded detent mechanism 16 mounted in yoke 70 with its detent 16A (e.g., a ball) extending into step region 14C to engage one of holes 81 from side 80B of ring 80. Such detent mechanisms are well known in the art. The spring force provided by detent mechanism 16 is sufficient to hold click ring 80 in place when dowel pin 90 is out of engagement therewith. However, with dowel pin 90 in one of holes 81, the forces generated by the turning of knob 14 are sufficient to overcome the spring force of detent mechanism 16 thereby allowing knob 14 to turn click ring 80/screw 78. Another advantage of detent mechanism 16 is that it provides an audible "click" as knob 14 is turned during the repositioning of the mechanism coupled to screw 78.

The advantages of the present invention are numerous. Control knob assembly 12 provides for easy position adjusting movement followed by a simple zeroing (referencing) operation in which knob 14 is simply pulled, rotated to a zero position, and released thereby allowing knob 14 to snap back in place without moving the mechanism to which it is attached.

Although the invention has been described with reference to specific embodiments, this description is illustrated and is not to be construed as limited in the scope of the invention. Various modifications will occur to those skilled in the art without departing from the spirit and scope of the invention as defined by the appended claims.

What is claimed as new and desired to be secured by Letters Patent of the United States is:

1. A control knob for selecting the zero position of a mechanism without altering the actual position of the mechanism, the mechanism having a shaft having first and second ends and with retaining means at said first end and with a keyway located between said first and second end thereof, said control knob comprising:

(a) a ring with a key placed in said keyway, said ring having a first dimensioned opening;

(b) a bushing having first and second ends with the second end having a lip thereat and with said bushing being dimensioned and placed around said shaft so that said lip abuts against said retaining means and so that said second end of said bushing abuts against said ring;

(c) a knob for gripping and having an interior with first, second and third cutouts each having predetermined dimensions, said knob having a second opening dimensioned to be complementary to said first opening;

(i) said first cutout being dimensioned so as to accept the insertion of said ring;

(ii) said second cutout being dimensioned so as to accept the insertion of said first end of said bushing;

(iii) said third cutout being dimensioned so as to accept said lip of said bushing;

(d) a spring having first and second ends and dimensioned for insertion into both of said first and second cutouts and so that said first end thereof abuts against said lip of said bushing; and (e) a pin inserted into said knob and into said ring wherein the selection of the zero position is initiated by gripping and pulling said knob outward.

2. A control knob assembly for selecting the zero position of a mechanism without altering the actual position of the mechanism having a shaft having first and second ends and with retaining means at said first end and with a keyway located between said first and second end thereof, said control knob comprising:

(a) a ring with a key placed in said keyway, said ring having a first dimensioned opening;

(b) a bushing having first and second ends with the second end having a lip thereat and with said bushing being dimensioned and placed around said shaft so that said lip abuts against said retaining means and so that said second end of said bushing abuts against said ring;

(c) a knob for gripping and having an interior with first, second and third cutouts each having predetermined dimensions and an exterior with first and second diameters, said second and third cutouts having a stepped arrangement, said knob having a second opening dimensioned to be complementary to said first opening;

(i) said first cutout being dimensioned so as to accept the insertion of said ring so that its first opening is in alignment with said second opening in said knob;

(ii) said second cutout being dimensioned so as to have a diameter to at least accept the insertion of said first end of said bushing;

(iii) said third cutout being dimensioned to have a diameter that is greater than the diameter of said second cutout and so as to accept said lip of said bushing;

(d) a spring having first and second ends and dimensioned for insertion into both of said first and second cutouts and so that said first end thereof abuts against said lip of said bushing; and (e) a pin dimensioned to be inserted into and maintained within both of said first and second openings wherein the selection of the zero position is initiated by gripping and pulling said knob outward.

3. A control knob assembly for selecting the zero position of a traverse and elevating mechanism for an automatic gun having a drive train and capable of continuous firing without altering the actual position of the mechanism, said mechanism having a shaft with first and second ends and with retaining means at said first end and with a keyway located between said first and second ends thereof, said second end of said shaft having coupling means for coupling to said automatic gun said control knob assembly comprising:

(a) a ring with a key placed in said keyway, said ring having a first dimensioned opening;

(b) a bushing having first and second ends with the second end having a lip thereat and with said bushing being dimensioned and placed around said shaft so that said lip abuts against said retaining means and so that said second end of said bushing abuts against said ring;

(c) a knob for gripping and having an interior with first, second and third cutouts each having predetermined dimensions, said knob having a second opening dimensioned to be complementary to said first opening, said knob having a dial thereon and having graduations around its border with one such graduation indicating said zero position of said traverse and elevating mechanism;

(i) said first cutout being dimensioned so as to accept the insertion of said ring;

(ii) said second cutout being dimensioned so as to accept the insertion of said first end of said bushing;

(iii) said third cutout being dimensioned so as to accept said lip of said bushing;

(d) a spring having first and second ends and dimensioned for insertion into both of said first and second cutouts and so that said first end thereof abuts against said lip of said bushing; and (e) a pin inserted into said knob and into said ring wherein the selection of the zero position is initiated by gripping and pulling said knob outward.

4. A control knob assembly for selecting the zero position of a traverse and elevating mechanism for an automatic gun having a drive train and capable of continuous firing without altering the actual position of the mechanism, said mechanism having a shaft with first and second ends and with retaining means at said first end and with a keyway located between said first and second ends thereof, said second end of said shaft having coupling means for coupling to said automatic gun, said control knob assembly comprising:

(a) a ring with a key placed in said keyway, said ring having a first dimensioned opening;

(b) a bushing having first and second ends with the second end having a lip thereat and with said bushing being dimensioned and placed around said shaft so that said lip abuts against said retaining means and so that said second end of said bushing abuts against said ring;

(c) a knob for gripping and having an interior with first, second and third cutouts each having predetermined dimensions and an exterior with first and second diameters, said second and third cutouts having a stepped arrangement, said knob having a second opening dimensioned to be complementary to said first opening, said exterior defined by said first diameter having a dial thereon and having graduations around its border with one such graduation indicating said zero position of said traverse and elevating mechanism;

(i) said first cutout being dimensioned so as to accept the insertion of said ring so that its first opening is in alignment with said second opening in said knob;

(ii) said second cutout being dimensioned so as to have a diameter to at least accept the insertion of said first end of said bushing;

(iii) said third cutout being dimensioned to have a diameter that is greater than the diameter of said second cutout and so as to accept said lip of said bushing;

(d) a spring having first and second ends and dimensioned for insertion into both of said first and second cutouts and so that said first end thereof abuts against said lip of said bushing; and (e) a pin dimensioned to be inserted into and maintained within both of said first and second openings wherein the selection of the zero position is initiated by gripping and pulling said knob outward.

5. A control knob assembly comprising:

a housing;

a shaft rotatably supported in said housing;

a ring coupled to said shaft wherein rotation of said ring causes rotation of said shaft, said ring having a plurality of holes distributed therearound and extending longitudinally therethrough from a first side thereof to a second side thereof;

a knob disposed about said shaft adjacent said first side of said ring, said knob being rotatable about said shaft and slidable therealong;

biasing means coupled between said knob and said ring for biasing said knob towards said ring;

first means fixedly coupled to said knob and extending therefrom for engaging one of said plurality of holes at said first side of said ring when said biasing means is free to bias said knob towards said ring;

second means mounted in said housing and extending therefrom for engaging one of said plurality of holes from said second side of said ring, said second means permitting rotation of said ring relative to said housing when said biasing means is free to bias said knob towards said ring, said second means inhibiting rotation of said ring relative to said housing when said biasing means is overcome by a pulling force that causes said first means to disengage from said one of said plurality of holes at said first side of said ring.

6. A control knob assembly as in claim 5 further comprising a first reference mark on said knob and a second reference mark on said housing, wherein said knob can be rotated when said biasing means is overcome by said pulling force such that said first reference mark is alignable with said second reference mark.

7. A control knob assembly as in claim 5 wherein said biasing means is a spring.

8. A control knob assembly as in claim 5 wherein said first means is a cylindrical rod.

9. A control knob assembly as in claim 5 wherein said second means is a spring-loaded detent.

10. A control knob assembly as in claim 5 wherein each of said plurality of holes tapers outward at said first side and said second side of said ring.

* * * * *